US007306524B1

(12) United States Patent
Rogers

(10) Patent No.: US 7,306,524 B1
(45) Date of Patent: Dec. 11, 2007

(54) METHOD AND APPARATUS FOR MEASURING THE SURFACE OF A GOLF GREEN

(75) Inventor: Wesley D. Rogers, Huntsville, AL (US)

(73) Assignee: Rogers Telecom Products, Inc., Huntsville, AL (US)

( * ) Notice: Subject to any disclaimer, the term of this patent is extended or adjusted under 35 U.S.C. 154(b) by 557 days.

(21) Appl. No.: 10/780,883

(22) Filed: Feb. 19, 2004

Related U.S. Application Data

(60) Provisional application No. 60/448,456, filed on Feb. 21, 2003.

(51) Int. Cl.
*A63B 67/02* (2006.01)

(52) U.S. Cl. ..... 473/167

(58) Field of Classification Search ..... 273/108.2, 273/108.21, 317, 108; 473/131, 198–199, 473/151–156, 167–168, 403–404
See application file for complete search history.

(56) References Cited

U.S. PATENT DOCUMENTS 3,215,436 A * 11/1965 Carter ..... 473/171
4,180,726 A * 12/1979 DeCrescent ..... 250/222.1
4,872,687 A * 10/1989 Dooley ..... 473/152
5,067,718 A * 11/1991 Knox et al. ..... 473/152
5,171,013 A * 12/1992 Dooley ..... 273/118 A
5,333,874 A * 8/1994 Arnold et al. ..... 473/156
5,387,903 A * 2/1995 Cutter et al. ..... 340/5.28
5,846,139 A * 12/1998 Bair et al. ..... 473/156
5,926,780 A * 7/1999 Fox et al. ..... 702/142
6,414,747 B1 * 7/2002 Hardy ..... 356/28
6,540,620 B1 * 4/2003 Consiglio ..... 473/150
6,749,527 B2 * 6/2004 Hughes ..... 473/404
6,860,139 B2 * 3/2005 Pelz ..... 73/9
2003/0166420 A1 * 9/2003 Chou ..... 473/151

OTHER PUBLICATIONS

"Stimpmeter Instruction Booklet"; http://www.usga.org/green/download/golf_course_management/stimpmeter.html; 4 pages.
"IR Wavelengths Check Putting Greens"; Photonics Technology News; Nov. 1999; http://www.photonics.com/Spectra/Tech/Nov99/techgolf.html; 2 pages.
"Uniform Putting Greens the Goal"; RN, Sep. 1997; http://ard.unl.edu/m/0997/PAGE20.HTM; 2 pages.
Streich et al.; "Quantifying the Impacts of Turfgrass Management on the Speed and Smoothness of Putting Greens"; http://www.diversitymag.org/divhome/steich.htm; 3 pages.
Pelz et al.; "The End of the Stimpmeter?"; Golf Magazine, Dec. 2002; 3 pages.

* cited by examiner

*Primary Examiner*—Kim Nguyen
(74) *Attorney, Agent, or Firm*—Edell, Shapiro & Finnan, LLC

(57) ABSTRACT

A golf green measuring device according to the present invention includes a plurality of spaced apart rails attached to an enclosed structure. The structure includes a control unit including a microcontroller, circuitry, a battery, a display and a level indicator. The rails include infrared emitters and detectors that sense a golf ball traveling through the enclosed structure. The microcontroller measures the elapsed time the golf ball travels between a pair of detectors disposed at the rail front end and the elapsed time the golf ball travels between another pair of detectors disposed at the rail rear end. The change in velocity or deceleration of the golf ball is determined based on the measured time intervals and converted into a speed value. The computed speed value is displayed on a device display. The device may include an optional printer to provide a hardcopy of the measurement.

27 Claims, 4 Drawing Sheets

METHOD AND APPARATUS FOR MEASURING THE SURFACE OF A GOLF GREEN

CROSS-REFERENCE TO RELATED APPLICATIONS

This application claims priority from U.S. Provisional Patent Application Ser. No. 60/448,456, entitled "Greens Speed Measuring Device" and filed Feb. 21, 2003, the disclosure of which is incorporated herein by reference in its entirety.

BACKGROUND OF THE INVENTION

1. Technical Field

The present invention pertains to devices measuring the surface or speed of golf greens. In particular, the present invention pertains to an apparatus for electronically sensing deceleration of a golf ball on a golf green and determining the speed of that green.

2. Discussion of the Related Art

Generally, the surface of a golf green is measured by golf course personnel to determine the speed of that green, where the speed values of golf greens may be utilized to provide consistency between the various greens of golf courses. This speed measurement relates to the distance a golf ball travels on the golf green in response to an initial velocity. The shorter the length of grass on the green, the farther a ball will travel for a given initial velocity, thereby yielding a higher measurement value or speed. Conversely, the longer the length of the grass, the shorter the distance traveled by the golf ball and the lower the measurement value or speed.

Currently, a STIMPMETER is utilized to measure the speed of a golf green. This device includes an extruded aluminum bar with a V-shaped groove defined therein extending along the entire length of the bar. One end of the bar is tapered and milled to enable placement of that end on the ground and to reduce bounce as a golf ball traverses the groove and makes contact with the green. A notch is disposed approximately thirty inches from the tapered end of the bar and provides a release point for the golf ball. The notch enables the golf ball to be released and start to roll through the groove when the bar is raised to or oriented at an angle of approximately twenty degrees relative to the ground. This ensures that the velocity of the golf ball is consistent at the tapered end for each measurement.

In operation, a golf ball is placed in the notch and one end of the aluminum bar is raised slowly until the ball rolls down the bar onto the grass surface of the golf green. The distance the golf ball travels is measured by the operator, typically in units of feet, and provided as the meter reading. For example, if the ball rolls eight feet, then the meter reading or speed of the golf green is eight. The measurement or meter reading is typically conducted for each of two opposite directions along the golf green and is based on the distances of travel of three golf balls utilized for each direction.

The related art described above suffers from several disadvantages. In particular, the above process to measure a golf green surface includes numerous manual procedures, typically requiring at least two people and enduring for five minutes or more, thereby increasing the time and effort to conduct a measurement. Further, the manual nature of the process reduces the accuracy and consistency of the measurement and may provide inconsistent readings or ones that do not correspond to the actual golf green conditions.

Moreover, the above process requires the golf green to be level in both directions in order to conduct a measurement, thereby restricting the use of the process to particular greens of a golf course.

OBJECTS AND SUMMARY OF THE INVENTION

Accordingly, it is an object of the present invention to measure the surface or speed of a golf green in an efficient, consistent and accurate manner.

It is another object of the present invention to measure the surface or speed of a golf green by electronically sensing and determining the deceleration of a golf ball along that green.

Yet another object of the present invention is to reliably measure the surface or speed of a golf green under various conditions (e.g., a substantially (but not perfectly) level surface, along one direction of a golf green, varying grains of the golf green, etc.).

The aforesaid objects may be achieved individually and/or in combination, and it is not intended that the present invention be construed as requiring two or more of the objects to be combined unless expressly required by the claims attached hereto.

According to the present invention, a golf green measuring device includes a plurality of substantially parallel rails that are spaced apart and attached to an enclosed structure. The structure maintains separation of the rails and provides a mounting surface for a control unit including a microcontroller or microprocessor, circuitry, a battery, a display and a level indicator. One rail includes a pair of infrared (IR) light emitting diode (LED) emitters disposed toward each of the front and rear ends of that rail, while the other rail includes photo-transistor receivers or detectors each disposed in that rail coincident a corresponding emitter. The infrared emitters and detectors sense a golf ball traveling through the enclosed structure to enable the microcontroller to determine and display the speed of the golf green. In particular, a golf ball is rolled between the rails, where the microcontroller measures the elapsed time the golf ball travels between the pair of detectors disposed at the rail front end. The microcontroller further records the elapsed time the golf ball travels between the pair of detectors disposed at the rear end of the rail. The microcontroller determines the change in velocity or deceleration of the golf ball based on the measured time intervals and converts that deceleration into a speed value. The computed speed value is displayed on a device display. The device may include an optional printer to provide a hardcopy of the measurement.

The present invention provides several advantages. In particular, the present invention provides an efficient manner to measure the surface of a golf green, where a measurement may be conducted by one person within seconds and may utilize a single trial of a golf ball traversing the device in either direction. Further, the present invention provides an accurate and consistent (or repeatable) measurement due to the inherent capabilities of electronic processors or computers. Moreover, the present invention enables reliable measurements under various conditions. For example, the device requires that the golf green be level in one direction, where a level unit disposed on the device simplifies the process of proper positioning. An accurate reading may be obtained as long as the slope of a golf green in the direction opposite of the measurement does not cause the golf ball to contact the rails during traversal of the device.

In addition, the present invention enables determination of the effects of the grain of the grass at a specific location on the golf green without moving the device since a valid reading may be obtained no matter which direction a golf ball traverses the device. For example, once the device is positioned on the golf green, a golf ball may be directed through the device in each of opposite directions, where the difference in the measurements indicates the effect of the grain of the grass on that location.

The above and still further objects, features and advantages of the present invention will become apparent upon consideration of the following detailed description of specific embodiments thereof, particularly when taken in conjunction with the accompanying drawings wherein like reference numerals in the various figures are utilized to designate like components.

DETAILED DESCRIPTION OF THE PREFERRED EMBODIMENTS

Generally, the surface of a golf green is measured to determine the speed of that green, where the speed values of golf greens may be utilized to provide consistency between the various greens of golf courses. This speed measurement is related to the distance a golf ball travels on the golf green in response to an initial velocity. For example, if a golf ball rolls eight feet, then the speed of the golf green is eight. The shorter the length of grass on the green, the farther a golf ball will travel for a given initial velocity, thereby yielding a higher speed value. Conversely, the longer the length of the grass, the shorter the distance traveled by the golf ball and the lower the speed value. The speed value is typically determined in a manual fashion by rolling golf balls across a golf green and measuring distances as described above.

Figure 1:
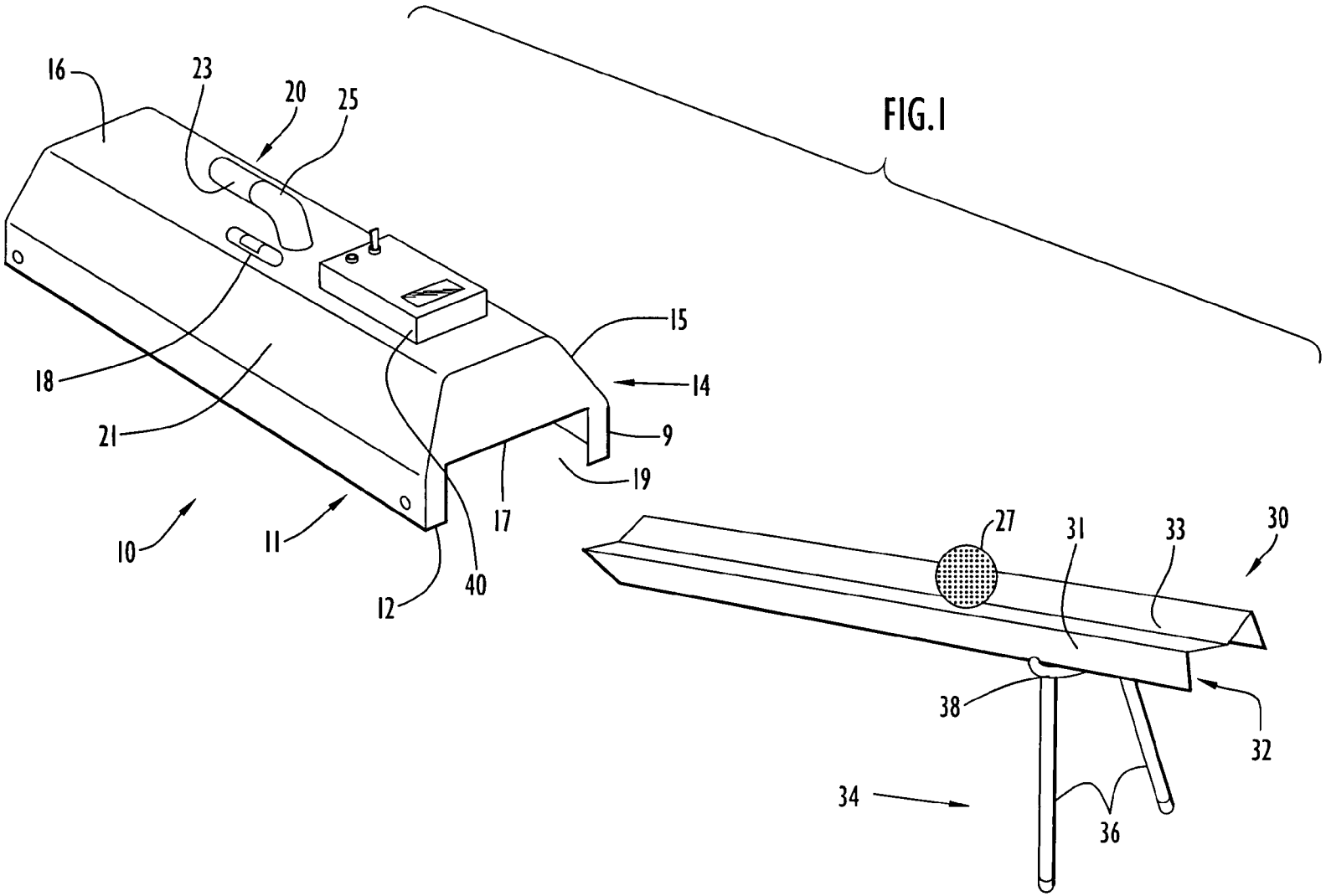
FIG. 1 is a view in perspective of a device for measuring the surface of a golf green according to the present invention.
Figure 2:
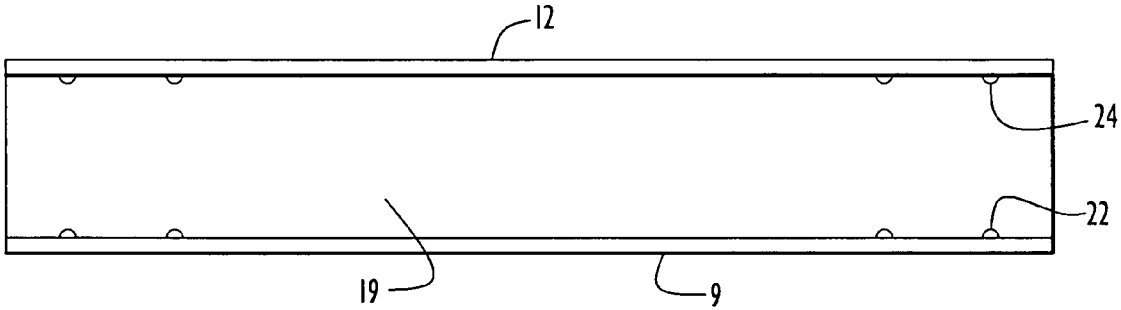
FIG. 2 is a bottom view in elevation of the measuring device of FIG. 1.

A device for electronically measuring the surface or speed of a golf green according to the present invention is illustrated in FIGS. 1-2. Specifically, device 10 includes a housing 11, a level unit 18 and a control unit 40. Housing 11 includes a pair of substantially parallel rails or support bars 9, 12 and an upper housing section 14 supported by the rails. The rails are each substantially rectangular and spaced apart, where the rails and supported upper housing section form an enclosed passage 19 through device 10. By way of example only, the rails each include a length or longer dimension of approximately thirty inches and are spaced apart by a distance of approximately eight inches. Alternatively, the rails may be of any size or shape and may be separated by any suitable distance. A pair of infrared (IR) emitters 22 (FIG. 2) are disposed toward each end of a rail 9. The emitters within each pair are disposed on an interior surface of the rail within passage 19 and are preferably spaced apart along the rail by approximately six inches. The emitters may alternatively be separated by any suitable distance. Similarly, a pair of infrared (IR) detectors 24 are disposed toward each end of rail 12 with each detector 24 disposed on an interior surface of that rail within passage 19. The detectors are each positioned substantially coincident a corresponding emitter 22 to detect the signal or beam transmitted by that emitter. The emitters are preferably implemented by light emitting diode (LED) type emitters, while detectors 24 are preferably in the form of photo-transistor receivers. However, the emitters and detectors may be implemented by any conventional or other emitters and/or detectors. The emitters and detectors sense a golf ball traversing passage 19 to determine deceleration of that ball as described below. Since sunlight or other ambient light may affect detectors 24, passage 19 is enclosed as described above to prevent interference by ambient light.

Upper housing section 14 is attached to and supported by the top edges of rails 9, 12. The upper housing section includes a generally trapezoidal cross section and encloses the area below that section defined between rails 9, 12 to form passage 19. The upper housing section includes top and bottom walls 16, 17 and side walls 15, 21, each substantially rectangular with lengths or longer dimensions substantially similar to those of the rails. The top and bottom walls are substantially parallel, where the width or shorter dimension of top wall 16 is less than that of bottom wall 17. Side wall 15 is disposed between and attached to the upper edge of rail 9 and lower edge of top wall 16, while side wall 21 is disposed between and attached to the upper edge of rail 12 and lower edge of top wall 16. The side walls are angled inward relative to the rails to accommodate the width differences between the top and bottom walls and form the trapezoidal configuration. By way of example only, the device is constructed of a suitably rigid plastic and includes a height of approximately eight inches, a width of approximately ten inches and a length of approximately thirty inches; however, the device may be of any size or shape and may be constructed of any suitable materials.

The top wall provides a mounting surface for receiving level unit 18 and control unit 40. The control unit is disposed toward a front end of the top wall with level unit 18 disposed rearwardly of and adjacent the control unit. Level unit 18 is preferably implemented by a conventional level device to indicate the slope of the golf green for identifying appropriate locations to conduct a measurement as described below. Control unit 40 houses control circuitry for device 10 and determines and displays the speed of an identified golf green based on detection times of a golf ball traversing passage 19 as described below. A handle 20 is further disposed on the top wall adjacent level unit 18 to facilitate transport of device 10. The handle includes a substantially cylindrical bar 25 with a generally 'L'-shaped configuration. The bar proximal end is attached to top wall 16, where the bar extends transversely therefrom initially, and subsequently in a direction toward the device rear end substantially parallel to the top wall. A grip 23 is disposed at the bar distal end with the handle 'L'-shaped configuration providing sufficient distance between the grip and housing top wall to enable a user to grasp the handle.

In order to conduct a measurement, a golf ball 27 is directed along the golf green and through passage 19. This may be accomplished by a person putting (e.g., with a golf club) or otherwise directing the golf ball through the passage. Alternatively, device 10 may be used in combination with a launch 30 to direct golf ball 27 through the device passage. Specifically, launch 30 includes a track member 32 and a stand 34. The track member includes side panels 31 and a generally rectangular platform 33. The platform includes a generally 'V-shaped' or recessed configuration and is disposed between and attached to the upper edges of each side wall to provide a path to direct or guide the golf ball. The track member includes an angled or tapered distal end to form a complementary arrangement or interface with the ground or golf green to enable a substantially smooth transition (e.g., minimal bounce) of golf ball 27 from the track member to the ground or golf green.

The track member proximal end is raised or supported by stand 34 to an angle relative to the ground or golf green sufficient to enable the golf ball to roll or traverse platform 33 and attain a desired velocity. The stand includes legs 36 and a platform support 38. The platform support includes a substantially cylindrical rod in a generally 'U'-shaped configuration. The dimensions of the platform support are slightly greater than the width or shorter dimension of the track member to receive a portion of the track member within the interior of the 'U'-shaped configuration. Legs 36 each include a substantially cylindrical rod and are attached to the underside of the platform support toward a respective opposing end portion. The legs each extend from the platform support at a slight outward angle to enhance stability. The stand typically engages the track member toward the track member proximal end. However, the stand may engage the track member at any suitable location. The launch enables a golf ball to attain a consistent initial velocity for each measurement.

Figure 3B:
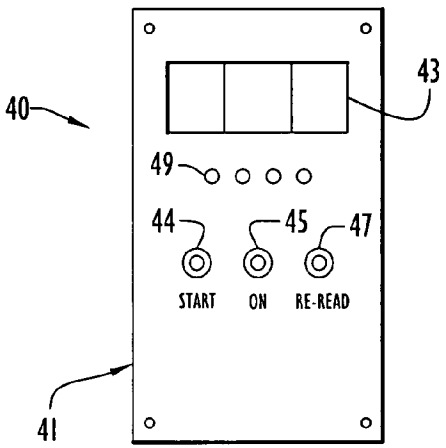
FIG. 3B is a front view in elevation of an alternative embodiment of the control unit of FIG. 3A.
Figure 3A:
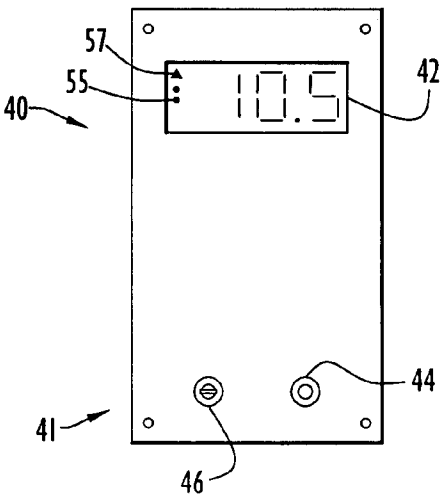
FIG. 3A is a front view in elevation of a control unit of the measuring device of FIG. 1.

Once a golf ball is directed through the device passage, control unit 40 determines and displays the speed of the green based on detections of the golf ball by emitters 22 and detectors 24. Referring to FIG. 3A, control unit 40 includes a housing 41, a display 42, a start button 44 and a power switch 46. The display, start button and power switch are connected to a control circuit 70 (FIGS. 4-5) disposed in housing 41 and described below. Display 42 is preferably implemented by a conventional liquid crystal display (LCD) and is disposed toward the upper end of housing 41. The display may display speed values with a maximum of three digits (e.g., including values with a decimal point). The display further includes sensor and low power indicators 55, 57. The sensor indicators are preferably in the form of a pair of dots or a colon to indicate detection of a golf ball by detectors 24. The sensor indicators remain enabled until a subsequent measurement is taken (e.g., the start button is depressed as described below). The power indicator is displayed in response to a device power source or batteries 51 (FIG. 4) attaining a minimum level. The device power source is preferably implemented by four double 'A' type batteries; however, any quantity of any type of conventional or other power source may be utilized.

Start button 44 and power switch 46 are disposed adjacent each other toward a housing lower end. Power switch 46 may be implemented by any type of toggle or other switching device and enables power to device 10. The start button may be implemented by any type of button or momentary switching device and prepares or resets device 10 to conduct a measurement. Basically, the control circuit receives a signal from each detector 24 during traversal of the golf ball through device passage 19. The control circuit determines the speed of the golf green based on elapsed time between these signals as described below and displays the resulting speed value on display 42. Once the detector signals are received, emitters 22 are disabled, while display 42 displays the resulting speed value until the start button is depressed indicating a new measurement is to be conducted.

Control unit 40 may employ various displays, buttons, indicators and/or switches. An exemplary alternative control unit is illustrated in FIG. 3B. Specifically, the control unit includes an LED display 43, start button 44, display value or re-read button 47, a power button 45 and a series of indicators or LEDs 49. Display 43 is preferably implemented by a conventional light emitting diode (LED) type display and is disposed toward the upper end of control unit housing 41. The display may display speed values with a maximum of three digits (e.g., including values with a decimal point). Start button 44, power button 45 and display value button 47 are disposed adjacent each other below display 43 and may be implemented by any type of button or momentary switching device. The power button enables power to the control unit, while the start button prepares or resets the device to conduct a measurement. Since an LED display typically has greater power consumption than an LCD display, a nine volt type battery is preferably employed to power the control unit. Further, the control unit and LED display may each power down after respective predetermined time intervals (e.g., five minutes for the control unit and five seconds for the display) to conserve power. In this case, the control unit maintains the measurement after the display power down and during the remainder of the control unit predetermined time interval, where the measurement may be displayed by depressing display value button 47. In addition, power button 45 may be depressed after expiration of the control unit predetermined time interval to conduct a new measurement. Indicators 49 are preferably implemented by light emitting diodes (LEDs) and are each associated with a corresponding detector 24. The indicators are disposed between the display and buttons 44, 45, 47 and indicate the proper operation of detectors 24, where the indicators are initially illuminated and subsequently individually disabled in response to a corresponding detector sensing the golf ball. Thus, the successive disablement of the indicators serves to display the progress of the golf ball through the device passage.

Figure 4:
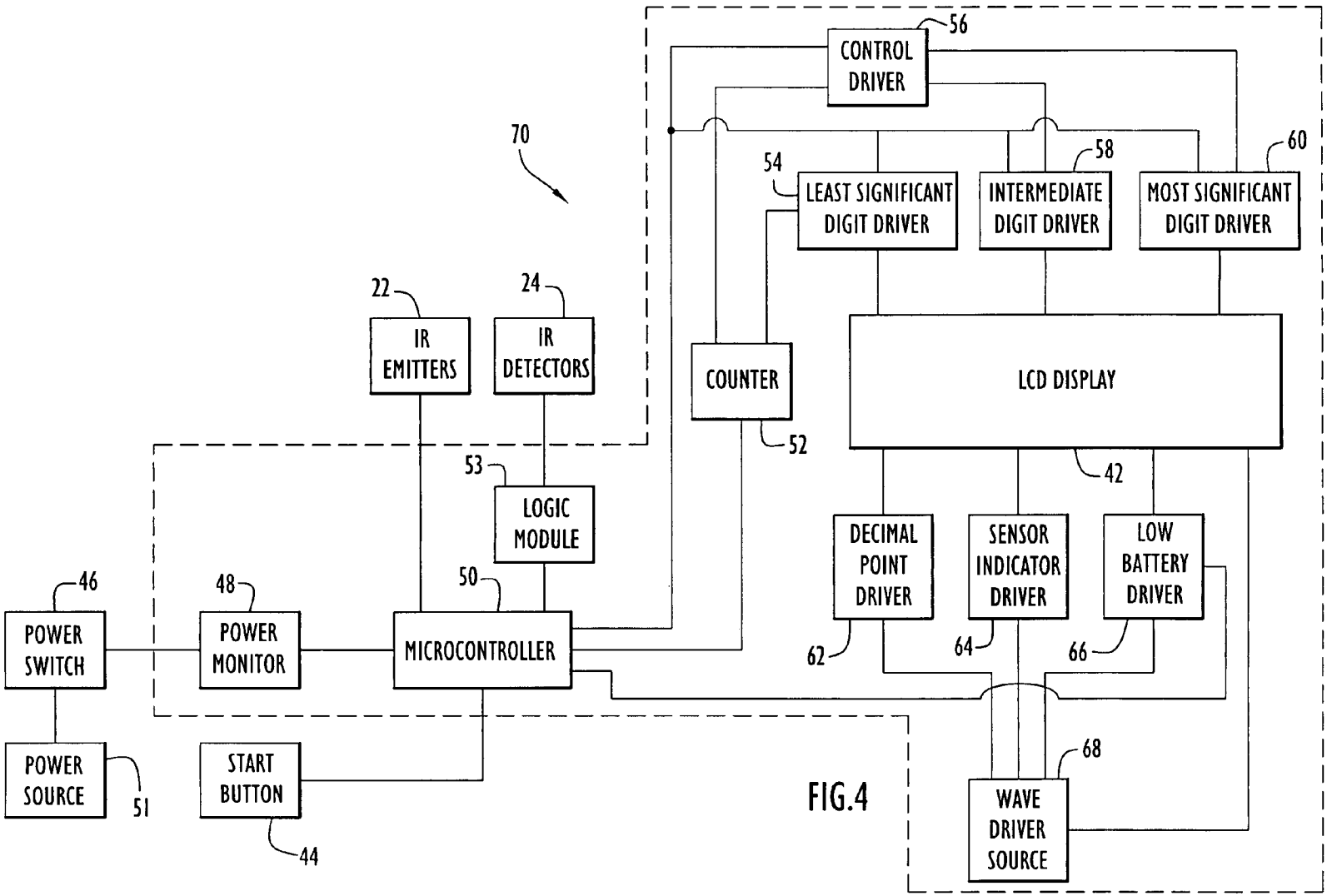
FIG. 4 is a schematic block diagram of exemplary control circuitry for the measuring device of FIG. 1.

An exemplary control circuit for control unit 40 (FIG. 3A) is illustrated in FIG. 4. It is to be understood that the exemplary control circuit may be modified to accommodate control units with various displays, buttons, switches and indicators (e.g., FIG. 3B, etc.). Specifically, control circuit 70 includes a microcontroller or processor 50 and display 42. A power source 51 provides power to the control circuit and is preferably implemented by four double 'A' type batteries. The microcontroller or processor controls device 10 and is preferably implemented by an eight bit microcontroller. By way of example only, the microcontroller may be implemented by the MOTOROLA HC705KJI microcontroller including ten bidirectional ports and operating at four megahertz (MHz). Display 42 is preferably implemented by a three digit, seven segment liquid crystal (LCD) type display unit and includes a sensor indicator and a low battery indicator as described above. The display is coupled to a wave driver source 68 that generates a low frequency square wave (e.g., thirty-two Hertz) to drive the display. The display is further coupled to a least significant digit driver 54, an intermediate digit driver 58, a most significant digit driver 60, a decimal point driver 62, a sensor indicator driver 64 and a low battery driver 66. These drivers control corresponding digits and indicators of display 42 to display the measured speed value of a golf green and corresponding device conditions as described below. The intermediate and most significant digit drivers are further coupled to a control driver 56 that controls display of these digits. The digit drivers are each associated with a corresponding digit having a particular location within the display, where the quantities represented by the digits depend on placement of a decimal point. By way of example only and with respect to the speed value shown in FIG. 3A, least significant digit driver 54 controls the display digit representing tenths, intermediate digit driver 58 controls the display digit representing ones or units, and most significant digit driver 60 controls the display digit representing tens. However, the digits controlled by these drivers may represent any quantities (e.g., tenths, hundredths, ones, tens, hundreds, etc.).

Microcontroller 50 is coupled to emitters 22, start button 44, a power monitor 48 and various drivers (e.g., least significant digit driver 54, control driver 56, intermediate digit driver 58, most significant digit driver 60, low battery driver 66, etc.). The start button resets the control unit in preparation for a measurement as described above. The power monitor is coupled to power switch 46 that controls power to the control circuit. The power monitor ensures appropriate power levels at start-up prior to enabling reset of the microcontroller. Infrared detectors 24 are further coupled to the microcontroller via a logic module 53. The logic module provides signals to the microcontroller indicating traversal of a detector by the golf ball to enable the microcontroller to determine golf ball deceleration and a speed value for a golf green as described below. The microcontroller is further coupled to a counter 52 that controls the least significant digit and control drivers 54, 56 to display the speed value based on the measurement.

Figure 5:
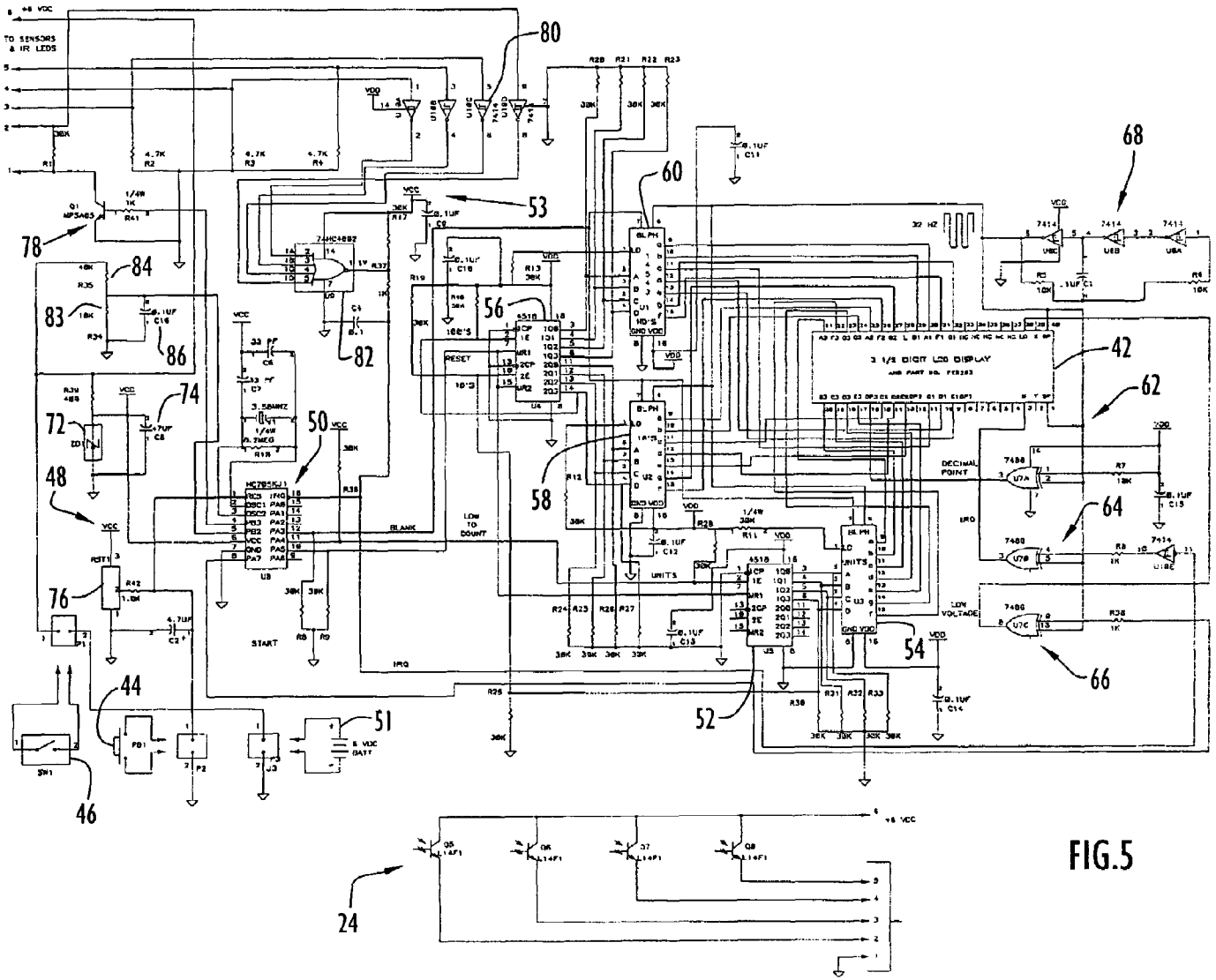
FIG. 5 is an exemplary electrical schematic diagram for the control circuitry of FIG. 4.

An exemplary electrical schematic of the control circuit of FIG. 4 is illustrated in FIG. 5. Specifically, power is supplied from power source 51 to power monitor 48 in response to actuation of power switch 46. The power monitor includes a zener diode 72 and a reset device 76. The zener diode (and an accompanying capacitor 74 arranged in a parallel relation) maintains a supplied voltage level (e.g., $V_{CC}$) within the operating limits of microcontroller 50. Reset device 76 maintains the reset line of microcontroller 50 at a low level until power is stabilized. The reset device basically provides a ground to the microcontroller reset line for a predetermined time interval (e.g., 350 milliseconds).

Once reset of the microcontroller is complete, a high level signal is produced at a microcontroller output (e.g., PB3 as viewed in FIG. 5). This signal enables a transistor 78 to apply power to infrared (IR) emitters 22 disposed within the device passage. The microcontroller reset further produces zeros on display 42. During transmission by IR emitters 22, corresponding detectors or photo-transistors 24 detect the transmitted energy and produce high level signals. These signals typically appear on pins (e.g., pins two, three, four and five as viewed in FIG. 5) of a connector (not shown) connecting detectors 24 to control circuit 70. The detector high level signals are provided to logic module 53. The logic module includes a series of inverters 80, each associated with a corresponding detector, and a logic unit 82 coupled to the inverters. The high level detector signals are inverted by corresponding inverters 80, thereby producing low level output signals at the inputs of logic unit 82. The logic unit preferably includes NOR type logic and produces a resulting high level output signal in response to low level input signals. The logic unit output is coupled to the microcontroller interrupt request line (e.g., IRQ as viewed in FIG. 5), where a low level signal triggers a microcontroller interrupt. Thus, a microcontroller interrupt is not generated by the logic unit as long as each detector senses the transmitted beam from a corresponding emitter.

However, when a golf ball traverses the device passage, the golf ball passes each detector and blocks or prevents detection by that detector of the beam transmitted by the corresponding emitter. The detector produces a low level signal in response to the golf ball blocking the transmitted beam that is inverted by an associated inverter 80. The resulting inverted or high level signal is provided at the input of logic unit 82. The NOR type logic of the logic unit produces a low level signal that triggers a microcontroller interrupt. In particular, when a golf ball is directed through the device passage, the golf ball prevents detection by or breaks the transmitted beam of an initial detector 24 (e.g., disables the detector or photo-transistor) located toward the passage front end. The associated inverter receives a low level signal and produces a high level signal at the corresponding input of logic unit 82. The NOR type logic of the logic unit produces a low level output signal on the microcontroller interrupt request line (e.g., IRQ as viewed in FIG. 5), thereby generating a microcontroller interrupt that initiates a timing measurement.

As the golf ball traverses the next detector in the device passage, that detector or photo-transistor is disabled and the associated inverter produces a high level signal at the input of logic unit 82 as described above. The logic unit produces a low level output signal on the microcontroller interrupt request line that generates an interrupt indicating the end of the timing interval. The timing measurement is recorded by the microcontroller. The golf ball continues through the device passage and disables the next detector or phototransistor disposed toward the passage rear end. The associated inverter produces a high level signal at the input of logic unit 82 as described above. The logic unit produces a low level output signal on the microcontroller interrupt request line that initiates another timing measurement. When the ball traverses the remaining passage detector 24, that detector or photo-transistor is disabled and the associated inverter produces a high level signal at the input of logic unit 82 as described above. The logic unit produces a low level output signal on the microcontroller interrupt request line that generates an interrupt indicating the end of the timing interval. The timing measurement is recorded by the microcontroller. The timing measurements may be further processed as described below, where the ratio of the measurements indicates golf ball deceleration. Since the microcontroller is triggered by interrupt request signals, a valid measurement may be achieved by the golf ball traversing the device passage in either direction (e.g., front to rear or rear to front). This greatly facilitates measuring the effects of the grain of the grass on the golf green, where the effects may be measured without positioning the device at a new location or in a different orientation.

Once an interrupt request associated with each detector has been received, the microcontroller produces a low level signal at a microcontroller output (e.g., PB3 as viewed in FIG. 5), thereby disabling transistor 78 and power to emitters 22 in order to conserve power source 51. The recorded time measurement between the first interrupt requests or between the first pair of detectors 24 traversed by the golf ball indicates initial velocity of the golf ball. The recorded time measurement between the second pair of detectors 24 traversed by the golf ball indicates the terminal velocity of the golf ball. An index is calculated from these values by the microcontroller and translated into a speed value for the golf green. In particular, the microcontroller determines an index based on the ratio of elapsed times between the final and initial pairs of detectors 24. In other words, the elapsed time between the final pair of detectors (e.g., indicating the terminal velocity of the golf ball) is divided by the elapsed time between the initial pair of detectors (e.g., indicating the initial velocity of the golf ball). The index is utilized to retrieve a speed value from a table stored in the microcontroller or other memory including speed values for various indices (e.g., golf ball velocity ratios) that were determined experimentally by conventional techniques (e.g., STIMPMETER, etc.). Alternatively, the microcontroller may record time stamps corresponding to the time a detector senses the golf ball and determine the speed value (e.g. distance the golf ball will travel) based on measured and other parameters (e.g., initial and terminal elapsed times and/or golf ball velocities, distances between detectors, etc.).

Once the speed value is determined, the speed value is displayed on display 42. In particular, pulses are created on a microcontroller output (e.g, PA4 as viewed in FIG. 5) and applied to counter 52. The quantity of pulses produced by the microcontroller corresponds to the quantity represented by the digits of the speed value (e.g., with placement of the decimal point after the least significant digit), where counter 52 is associated with the least significant digit of the speed value. For example, the microcontroller produces one hundred five pulses for speed values of 10.5, 1.05 or 0.105. The counter is incremented in response to each pulse received from the microcontroller and maintains a count between zero and nine. The count or output of the counter is coupled to least significant digit driver 54 (e.g., latch/decoder, etc.) that controls the least significant digit of the display. This driver is basically a binary coded decimal (BCD) to seven segment driver/decoder that receives the counter output and produces signals to display the count value on display 42 (e.g., the signals enable the appropriate display segments to display the count value). When counter 52 reaches a value of nine, the next pulse resets the counter and produces a pulse on an input of control driver 56 (e.g., 2E as viewed in FIG. 5) associated with counters for the intermediate and most significant digits.

The control driver is implemented by a counter that maintains counts for the intermediate and most significant digits of the display. Counter outputs associated with the intermediate digit count are coupled to intermediate digit driver 58, while counter outputs for the most significant digit count are coupled to most significant digit driver 60. The control driver maintains counts between zero and nine for the intermediate and most significant digits, where the intermediate digit count is incremented for every ten pulses of counter 52, and the most significant digit count is incremented for every ten counts or increments of the intermediate digit count. Basically, when the count or quantity of pulses on the control driver input for the intermediate digit counter reaches a value of nine, the next pulse resets the intermediate digit count and produces a pulse on the control driver input (e.g., 1E as viewed in FIG. 5) to increment the most significant digit count. The intermediate and most significant digit drivers are each implemented by a respective binary coded decimal (BCD) to seven segment driver/decoder. Each driver receives the corresponding counter output (e.g., intermediate and most significant digit counts) and produces signals to display that count value on display 42 (e.g., the signals enable the appropriate display segments to display the count value).

During the counting process described above, a high level blanking signal is transmitted on a microcontroller output (e.g., PA3 as viewed in FIG. 5) that is coupled to the least significant, intermediate and most significant digit drivers. This signal disables the drivers to prevent display of the various digits until the pulses from the microcontroller have been counted. After the pulses have been transmitted by the microcontroller, the high level blanking signal is removed from the microcontroller output (e.g., PA3 as viewed in FIG. 5) and the drivers are enabled to display the various counts representing the speed value digits on display 42. When start button 44 is actuated or depressed, a reset occurs that prepares device 10 for a measurement. The start button further resets counters 52, 56 to initialize the display (e.g., to display zeros) and enables infrared (IR) emitters 22.

Decimal point driver 62, sensor indicator driver 64 and low battery driver 66 are preferably implemented by dual input AND type logic devices with one input coupled to wave driver source 68. The decimal point driver generally controls display of the decimal point. Sensor indicator driver 64 controls display of two dots or a colon to indicate that detectors 24 are functioning properly. When a reset is initiated (e.g., start button 44 is actuated or depressed), the sensor indicator is initially removed, where the indicator blinks or flashes in response to a golf ball traversing a detector 24 (e.g., the golf ball interrupts or blocks detector 24 from detecting a beam transmitted by a corresponding emitter 22). The sensor indicator driver is further coupled to the microcontroller interrupt request line (e.g., IRQ as viewed in FIG. 5) to determine traversal of a detector by the golf ball (e.g., an interrupt is generated when a golf ball traverses a detector as described above). After four interruptions (e.g., the golf ball has traversed the device passage), the interrupt request line of the microcontroller enters and maintains a low level state until start button 44 is actuated or depressed, thereby preventing display of the sensor indicator between measurements.

The low battery indicator is controlled by low battery driver 66. The microcontroller basically monitors a voltage divider circuit (e.g., including a resistor 83 arranged in series with a parallel arrangement of a resistor 84 and a capacitor 86 as viewed in FIG. 5) coupled to power source 51. When the microcontroller senses a low level signal on a microcontroller input (e.g., PB2 as viewed in FIG. 5) relative to a threshold, the microcontroller transmits a high level signal on a microcontroller output (e.g., PA7 as viewed in FIG. 5) that enables low battery driver 66 to display the low battery indicator. The control circuit components may be implemented by any conventional or other devices and may be arranged in any fashion. The component characteristics (e.g., resistance, capacitance, etc.) illustrated in FIG. 5 are exemplary, where the circuit components may include any desired characteristic values.

Operation of device 10 is described with reference to FIGS. 1 and 4. Initially, a golf green location that is level in at least one direction is identified to perform a measurement. This identification may be performed by placing device 10 at the desired golf green location and observing the indication of level unit 18. Once the desired location is identified, golf ball 27 is directed through the device passage. This may be accomplished by putting or otherwise directing the golf ball through the passage. Alternatively, the golf ball may be directed through the device passage via launch 30. In this case, the golf ball is placed on the launch track member, where the golf ball rolls along the track member and into and through the device passage as described above.

As the golf ball traverses an initial pair of detectors 24 within the device passage, microcontroller 50 measures and records the elapsed travel time of the golf ball between the two detectors. The microcontroller similarly measures and records the elapsed travel time of the golf ball between the terminal pair of detectors and determines the index (e.g., change or ratio of initial and terminal velocities) as described above. The index is utilized to retrieve a corresponding speed value from a table stored within the microcontroller or other memory. Alternatively, the microcontroller may determine the speed value based on the measured and other parameters. The resulting speed value is displayed on display 42. Device 10 may further include or be coupled to a printer to provide a report or hardcopy of the measured speed or other values. Further, the device may measure the speed of a golf green with a single pass of a golf ball, while the golf ball may traverse the device passage in either direction to obtain a speed measurement. Thus, the device may measure the effects of the grain of the grass on the golf green (e.g., by comparing the measured speed value for each direction) without having to re-position the device.

It will be appreciated that the embodiments described above and illustrated in the drawings represent only a few of the many ways of implementing a method and apparatus for measuring the surface of a golf green.

The device may be of any shape or size and may be constructed of any suitable materials. The device housing may be of any shape or size and may be constructed of any suitable materials. The rails may be of any quantity, shape or size and may be constructed of any suitable materials. The rails may be spaced apart by any suitable distance and may be arranged in any relation relative to each other (e.g., substantially parallel, converging or diverging, etc.). Each of the rails may include any quantity of any type of emitter and/or detector secured thereto or embedded therein in any fashion (e.g., brackets, adhesives, formed integral, etc.) or arrangements and at any locations.

The housing upper section may be of any shape or size and may be constructed of any suitable materials. The upper housing walls (e.g., top, bottom, side, etc.) may be of any shape or size and arranged in any fashion (e.g., the walls may be oriented at any desired angles relative to each other, etc.) for any cross-sectional configuration. The upper section may be permanently or removably attached to the rails via any conventional or other techniques (e.g., welding, brackets, etc.). The handle may be of any quantity, may be disposed at any location, may be implemented by any conventional or other handle and may include any type of configuration (e.g., 'L'-shape, 'C' shape, etc.). The handle bar may be of any shape or size and include any conventional or other grip disposed at any suitable location.

The ball may be directed through the device passage in any desired manner (e.g., putted via a golf club, launch, mechanism or device to project the ball, etc.). The resulting speed value may be based on any quantity of measurements of golf balls or other objects directed through the device for any quantity of directions, where the measurements may be combined in any fashion (e.g., averaged, weighted, summed, etc.) by the operator and/or microcontroller to produce the resulting speed value. The launch may be of any shape or size and may be constructed of any suitable materials. The track member and associated components (e.g., side panels, platform, etc.) may be of any shape or size and may be constructed of any suitable materials. The platform may include any configuration suitable to maintain and guide the ball (e.g., recessed, 'V' shaped, curved, etc.). The stand and associated components (e.g., platform support, legs, etc.) may be of any shape or size and may be constructed of any suitable materials. The platform support may be of any quantity and include any suitable configuration to engage and support the track member (e.g., 'U'-shaped, etc.). The legs may be of any quantity and may be attached or secured to the platform support in any fashion (e.g., welded, brackets, etc.) and at any desired locations. The legs may alternatively be directly attached to the track member without the platform support. The launch may be configured to orient the track member at any desired angle relative to the ground to enable the ball to attain any desired velocity. The launch may be disposed at any desired distance from the measuring device to direct the ball through that device.

The device passage may be of any shape or size, and may include any type of path for the ball (e.g., linear, curved, etc.). The passage may include any quantity of emitters and/or detectors disposed at any suitable locations and arranged in any desired fashion (e.g., spaced by any desired distances, etc.). The passage may alternatively include any sensing or detecting devices (e.g., pressure sensors or switches, buttons, switching devices, etc.) to detect traversal of the golf ball or other object through the passage. The passage is preferably enclosed to prevent interference from ambient light, but may be open or include any desired degree of transparency (e.g., transparent, translucent, opaque, etc.). The emitters may be implemented by any quantity of any conventional or other emitters (e.g., LED emitters, etc.) transmitting any desired energy (e.g., infrared, light, laser, ultrasonic, etc.). Similarly, the detectors may be implemented by any quantity of any conventional or other detectors (e.g., photo-transistors, etc.) detecting any desired energy (e.g., infrared, light, laser, ultrasonic, etc.). The emitters and detectors may be arranged in any fashion and may each be separated from adjacent or corresponding emitters and/or detectors by any suitable distances.

The level unit may be implemented by any quantity of any conventional or other level device and may be disposed at any suitable location on the measuring device. The control unit may be of any shape or size and may be constructed of any suitable materials. The control unit may be disposed at any suitable location on the measuring device. The control unit housing may be of any shape or size and may be constructed of any suitable materials. The display may be implemented by any quantity of any conventional or other displays (e.g., LED, LCD, etc.) and may display any desired quantity of digits or indicators. The display may be disposed at any suitable location on or within the control unit and may display any desired information. The control unit may include any quantity of any conventional or other buttons, switching devices or indicators (e.g., momentary switch, pole switch, toggle switch, LEDs, audio indicator, visual indicator, etc.) to control functions (e.g., start button, power button or switch, display button, etc.) or indicate conditions. The buttons, switches and/or indicators may be disposed at any suitable locations on or within the control unit. The control unit and/or display may be powered down after expiration of any desired time interval to conserve power.

The control circuit may be implemented by any quantity of any conventional or other components (e.g., diodes, transistors, resistors, capacitors, processors, counters, logic, gates, etc.) arranged in any fashion to perform the functions described herein. The circuit components may be arranged in any fashion and may include any desired characteristic values (e.g., resistance, capacitance, etc.). The power source may be implemented by or receive power from any quantity of any conventional or other power source (e.g., vehicle electrical system, generator, wall outlet, rechargeable battery, consumer batteries (e.g., 'AA', 9V, etc.), etc.). The power monitor may include any quantity of conventional or other components (e.g., diodes, capacitors, resistors, etc.) to maintain the input voltage and delay reset of the microcontroller. The reset device may be implemented by any quantity of conventional or other components and may apply ground to the reset line for any desired time interval.

The microcontroller may be implemented by any quantity of any conventional or other processor. The counters may be implemented by any conventional or other counting devices (e.g., counters, ALU, logic, etc.). The microcontroller may generate any quantity of pulses in response to a speed value to control the drivers to display that value. The wave driver source may be implemented by any conventional or other components or signal generators to produce the signal to drive the display. The display driving signal may be of any desired frequency. The digit drivers may be associated with any display digit and may be in the form of any conventional or other driving or decoding device to produce signals from any type of input to display a desired value (e.g., BCD decoder, etc.). For example, the microcontroller may output the value of each speed value digit directly to the corresponding driver (e.g., without employing the pulses or counters) to enable display of that value. Alternatively, the microcontroller may output display control signals to control the display (e.g., decode the speed value digits internally for output to the display, etc.) to enable display of that value and/or the indicators. The display digits may be associated with any quantity of units in accordance with placement of the decimal point (e.g., ones, tens, hundreds, tenths, hundredths, etc.). The speed value may be processed in any desired fashion by any control circuit or other devices (e.g., microcontroller, drivers, counters, etc.) to produce appropriate display control signals to enable display of that value. The logic module may include any quantity of any type of logic device (e.g., AND, OR, NAND, NOR, gates, circuitry, etc.) and may accommodate data or signals in inverted or non-inverted form (e.g., with or without the inverters). The inverters may be implemented by any quantity of conventional or other inverting devices (e.g., gates, transistors, etc.).

The sensor and low battery indicators may be of any quantity and in the form of any desired symbol or alphanumeric, punctuation or other characters and may be shown on the display at any desired locations and in any fashion. The decimal point may be displayed on the display at any desired location and in any fashion. The drivers for the decimal point and indicators may include any quantity of any conventional or other logic (e.g., AND, OR, NAND, NOR, gates, circuitry, etc.) or control devices (e.g., circuitry, processor, etc.) to control their display. The low battery detector may be implemented by any conventional or other devices or circuitry (e.g., meter, voltage divider circuit, etc.). A low battery or power indication may be indicated based on any desired threshold.

The table may include any quantity of speed values arranged or accessible in any fashion. The table may be implemented by any quantity of any type of data structure or storage device (e.g., array, table, list, queue, stack, buffer, etc.). The table may be stored in the microcontroller memory or any type of memory or storage device accessible to the microcontroller locally or remotely. The speed values in the table may be accessed based on any desired indices, keys or values. The microcontroller may determine the table key based on any mathematical or other operations applied to measured or known parameters. Alternatively, the microcontroller may determine the speed value or distance of travel of the golf ball or other object based on the measured or known parameters (e.g., time or velocity, distances, etc.).

It is to be understood that software for the microcontroller may be implemented in any desired computer language, and could be developed by one of ordinary skill in the computer and/or programming arts based on the functional description contained herein. Further, any references herein of software performing various functions generally refer to computer systems or processors performing those functions under software control. The microcontroller may alternatively be implemented by hardware or other processing circuitry. The various functions of the microcontroller and/or control circuit may be distributed in any manner among any quantity (e.g., one or more) of hardware and/or software modules or units, computer or processing systems or circuitry, where the computer or processing systems may be disposed locally or remotely of each other and communicate via any suitable communications medium. The algorithms and/or control circuit described above may be modified in any manner that accomplishes the functions described herein.

The measuring device may be linked via any communication medium to a local or remote processor (e.g., computer, etc.) or printing device to provide measurements to local or remote users. The printing device may alternatively be housed within the measuring device to provide a hardcopy of the measurement and any other desired information (e.g., measured parameters, etc.).

It is to be understood that the terms "top", "bottom", "front", "rear", "side", "height", "length", "width", "upper", "lower" and the like are used herein merely to describe points of reference and do not limit the present invention to any particular orientation or configuration.

The measuring device of the present invention is not limited to the applications described above, but may be utilized to measure various surfaces (e.g., baseball infield/outfield, polo grounds, croquet fields, football fields, tennis courts, pool tables, etc.) upon which activities may be conducted. Further, the measuring device may determine deceleration of various objects (e.g., baseball, polo ball, croquet ball, tennis ball, etc.) directed through the device (which may or may not pertain to the particular activity for the surface) to produce a measurement. For example, a golf ball may be utilized to measure a baseball field, polo ground or other surface. In addition, the measuring device may be adapted to convert the measured parameters or elapsed time into any desired scale (e.g., pertaining to an activity, etc.).

From the foregoing description, it will be appreciated that the invention makes available a novel method and apparatus for measuring the surface of a golf green, wherein a device electronically measures deceleration of a golf ball on the green and determines the speed of that green based on the measurements.

Having described preferred embodiments of a new and improved method and apparatus for measuring the surface of a golf green, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. A device for measuring a property of a surface comprising:

a housing with a passage defined therein;

a plurality of detection units disposed within said passage to detect traversal of said passage by an object directed therethrough, wherein said passage includes a first pair of detection units disposed toward a first end of said passage and separated by a first predetermined distance and a second pair of detection units disposed toward an opposing end of said passage and separated by a second predetermined distance; and a control unit disposed on said housing and coupled to said detection units to determine deceleration of said object through said passage due to said surface, wherein said control unit includes:

a processor to determine said deceleration in accordance with detections from said detection units and to produce based on said deceleration a resultant measurement value indicative of said surface property and in relation to a predetermined scale, wherein said resultant measurement value pertains to a total distance said object travels on said surface in response to an initial predefined reference velocity, and wherein said processor includes:

a first interval module to measure elapsed time for said object to travel between said first pair of detection units; and a second interval module to measure elapsed time for said object to travel between said second pair of detection units; and a display to display said resultant measurement value.

2. The device of claim 1, wherein said passage includes first and second walls in facing relation and spaced apart from each other, and wherein each said detection unit includes:

an emitter disposed in said first wall to transmit an energy signal toward said second wall; and a detector disposed within said second wall substantially coincident with said emitter to detect said energy signal.

3. The device of claim 2, wherein said energy signal is in the form of an infrared signal.

4. The device of claim 1, wherein said display includes at least one of an LED display and an LCD display.

5. The device of claim 1, further including:

a guide to direct said object into said passage at a desired velocity.

6. The device of claim 5, wherein said guide includes:

a track member to receive and direct said object into said passage; and a stand to elevate a portion of said track member relative to said surface to enable said object to traverse said track member and attain said desired velocity.

7. The device of claim 1, wherein said surface includes a golf green and said scale corresponds to speed values for said golf green.

8. The device of claim 1, wherein said housing further includes a level unit to indicate a slope of said surface.

9. The device of claim 1, wherein said control unit includes a power source and said display includes a power indicator to indicate a power level of said power source.

10. The device of claim 1, wherein said display includes at least one of a decimal point and a detector indicator to indicate detection of said object within said passage by said detection units.

11. The device of claim 1, wherein said control unit includes a plurality of detector indicators to indicate detection of said object within said passage by said detection units.

12. The device of claim 1, wherein said processor further includes:

an index module to determine an index corresponding to a ratio of said elapsed times measured by said first and second interval modules; and a retrieval module to retrieve a corresponding value from a storage unit based on said index, wherein said retrieved value serves as said resultant measurement value.

13. The device of claim 12, wherein values stored within said storage unit correspond to surface property values determined in accordance with prior surface measurements.

14. The device of claim 1, wherein said object includes a golf ball.

15. A method of measuring a property of a surface comprising:

(a) receiving an object within a passage defined in a housing, wherein a plurality of detection units are disposed within said passage;

(b) detecting traversal of said passage by said object directed therethrough via said plurality of detection units;

(c) determining deceleration of said object through said passage due to said surface in accordance with detections from said detection units, wherein said passage includes a first pair of detection units disposed toward a first end of said passage and separated by a first predetermined distance and a second pair of detection units disposed toward an opposing end of said passage and separated by a second predetermined distance, and step (c) further includes:

(c.1) measuring elapsed time for said object to travel between said first pair of detection units; and (c.2) measuring elapsed time for said object to travel between said second pair of detection units;

(d) producing a resultant measurement value indicative of said surface property and in relation to a predetermined scale based on said determined deceleration, wherein said resultant measurement value pertains to a total distance said object travels on said surface in response to an initial predefined reference velocity; and (e) displaying said resultant measurement value on a display.

16. The method of claim 15, wherein said passage includes first and second walls in facing relation and spaced apart from each other, and step (b) further includes:

(b.1) each said detection unit transmitting an energy signal from said first wall toward said second wall via an emitter disposed in said first wall and detecting said transmitted energy signal via a detector disposed within said second wall substantially coincident with said emitter.

17. The method of claim 16, wherein said energy signal is in the form of an infrared signal.

18. The method of claim 15, wherein step (e) further includes:

(e.1) displaying said resultant measurement value on at least one of an LED display and an LCD display.

19. The method of claim 15, wherein step (a) further includes:

(a.1) directing said object into said passage at a desired velocity via a guide.

20. The method of claim 19, wherein said guide includes a track member to receive and direct said object, and step (a.1) further includes:

(a.1.1) elevating a portion of said track member relative to said surface to enable said object to traverse said track member and attain said desired velocity.

21. The method of claim 15, wherein said surface includes a golf green and said scale corresponds to speed values for said golf green.

22. The method of claim 15, wherein step (a) further includes:

(a.1) measuring and indicating a slope of said surface.

23. The method of claim 15, wherein said housing includes a power source, and wherein step (e) further includes:

(e.1) displaying a power indicator to indicate a power level of said power source.

24. The method of claim 15, wherein step (b) further includes:

(b.1) enabling at least one detector indicator to indicate detection of said object within said passage by said detection units.

25. The method of claim 15, wherein step (d) further includes:

(d.1) determining an index corresponding to a ratio of said measured elapsed times; and (d.2) retrieving a corresponding value from a storage unit based on said index, wherein said retrieved value serves as said resultant measurement value.

26. The method of claim 25, wherein values stored within said storage unit correspond to surface property values determined in accordance with prior surface measurements.

27. The method of claim 15, wherein said object includes a golf ball.

* * * * *